US012188727B1

(12) United States Patent
Naor et al.

(10) Patent No.: US 12,188,727 B1
(45) Date of Patent: Jan. 7, 2025

(54) SYSTEMS AND METHODS FOR VERIFICATION AND CALIBRATION USING KNOWN REFERENCE CHEMICAL SOLUTIONS

(71) Applicant: CI SYSTEMS (ISRAEL) LTD., Migdal Haemek (IL)

(72) Inventors: Yoram Naor, Givat Elah (IL); Lyor Kogan, Migdal Haemek (IL)

(73) Assignee: CI SYSTEMS (ISRAEL) LTD., Migdal Haemek (IL)

( * ) Notice: Subject to any disclaimer, the term of this patent is extended or adjusted under 35 U.S.C. 154(b) by 0 days.

(21) Appl. No.: 18/509,376

(22) Filed: Nov. 15, 2023

(51) Int. Cl.
*F28D 7/00* (2006.01)
*F28F 27/02* (2006.01)

(52) U.S. Cl.
CPC ..... *F28D 7/0016* (2013.01); *F28F 27/02* (2013.01); *F28F 2250/00* (2013.01)

(58) Field of Classification Search
CPC ..... F28D 7/0016; F28D 7/024; F28F 27/02; F28F 2250/00; F28F 2265/00; F28F 2200/00; B01D 15/08; B01D 15/12; B01D 15/161; B01D 15/3871; B01D 2015/3895; G01N 15/1436; G01N 33/1893; G01N 35/00712; G01N 21/05
See application file for complete search history.

(56) References Cited

U.S. PATENT DOCUMENTS 4,326,940 A * 4/1982 Eckles ..... G01N 35/1097 422/62
4,441,374 A * 4/1984 Suzuki ..... G01N 1/38 73/864.22
4,992,380 A * 2/1991 Moriarty ..... F28F 25/00 422/62
5,160,604 A * 11/1992 Nakamura ..... C12Q 1/001 210/85
5,364,510 A * 11/1994 Carpio ..... G05D 21/02 204/406
5,604,132 A * 2/1997 Capuano ..... G01N 35/085 436/171
5,722,441 A * 3/1998 Teramoto ..... B08B 3/10 257/E21.228
6,104,483 A * 8/2000 Sebok ..... G01N 21/05 356/244
6,257,955 B1 * 7/2001 Springer ..... F28F 9/0132 451/60

(Continued)

*Primary Examiner* — Travis Ruby
(74) *Attorney, Agent, or Firm* — Rivka Friedman

(57) ABSTRACT

A heat exchanger has a first inlet in fluid communication with a tank that contains a first chemical solution of a known concentration, and a second inlet in fluid communication with a conduit. The conduit is in fluid communication with a process tool and conveys a second chemical solution from the process tool to the second inlet. The heat exchanger receives a quantity of the first chemical solution via the first inlet and a quantity of the second chemical solution via the second inlet, and adjusts a temperature of the received quantity of the first chemical solution to bring the temperature of the received quantity of the first chemical solution toward a temperature of the received quantity of the second chemical solution. The temperature-adjusted first chemical solution can be selectively provided to an analytic flow cell for verification and/or calibration of the flow cell.

10 Claims, 4 Drawing Sheets

(56) References Cited

U.S. PATENT DOCUMENTS

| | | | | |
|---|---|---|---|---|
| 6,267,853 | B1 * | 7/2001 | Dordi | C25D 17/001 204/297.08 |
| 6,484,569 | B1 * | 11/2002 | Plant | F28D 7/106 73/61.57 |
| 6,679,083 | B1 * | 1/2004 | Erickson | F25B 37/00 62/484 |
| 7,157,051 | B2 * | 1/2007 | King | G01N 35/1097 422/68.1 |
| 7,515,259 | B2 * | 4/2009 | Hilmer | G01N 30/74 356/440 |
| 7,851,222 | B2 * | 12/2010 | Hoermann | C25D 17/001 204/240 |
| 10,591,408 | B2 * | 3/2020 | Naor | G01N 21/59 |

* cited by examiner

SYSTEMS AND METHODS FOR VERIFICATION AND CALIBRATION USING KNOWN REFERENCE CHEMICAL SOLUTIONS

TECHNICAL FIELD

The present disclosure relates to semiconductor fabrication, and in particular verification and calibration of analytical optical flow cells used in wet cleaning and etching semiconductor fabrication processes using known reference chemical solutions.

BACKGROUND OF THE INVENTION

Various chemical solutions are used during semiconductor and electronic device manufacturing processes. One group of chemical solutions that are used during processing includes wet cleaning and etching chemistries (solutions), which are used to remove impurities from semiconductor wafers. In addition to impurity removal, these solutions can also be used for material removal, patterning, polymers and contaminant removal. Wet cleaning and etching chemistries are typically heated in order to increase their operational efficiency. During semiconductor processing, it is critical to maintain accurate concentration of the heated solutions to preserve optimal yield and reduce or prevent defects. One key aspect of ensuring this concentration accuracy is the periodic analysis of these solutions using some type of on-line automated metrology or analysis tool, for example an analytic flow cell system that can analyze chemical solutions to calculate concentration based on measurements associated with detected light that has traversed through the flow cell body. In order to ensure analytical accuracy of the flow cell, a periodic measurement of a solution of known chemistry (i.e., known concentration), is introduced in the flow cell measurement channel. The calculated concentration can be compared with the known concentration, and the optical metrology of the flow cell system can be verified and calibrated to compensate for deviations which relate to the flow cell usage and its typical degradation In conventional approaches, the heated cleaning solution is cooled to the ambient temperature to match the temperature of the solution of known chemistry. However, this method can be complex, less accurate, and time consuming.

SUMMARY OF THE INVENTION

The present disclosed subject matter, also referred to herein as the disclosure, includes systems and methods for verifying and calibrating flow cells used in semiconductor fabrication processes with automatic verification and calibration with standard chemical solutions. According to certain embodiments, a heat exchanger is provided with functions to receive a heated process solution and a lower-temperature reference solution, and functions to activate a heat transfer process between the process solution and the reference solution so as to heat the reference solution to a requisite temperature prior to the reference solution being input to an analytic optical flow cell.

According to the teachings of an embodiment of the present disclosure, there is provided a system that comprises: a conduit; and a heat exchanger including a first inlet in fluid communication with a tank that contains a first chemical solution of a known concentration and a second inlet in fluid communication with the conduit, the conduit is in fluid communication with a process tool and conveys a second chemical solution from the process tool to the second inlet, the heat exchanger is configured to receive a quantity of the first chemical solution via the first inlet and a quantity of the second chemical solution via the second inlet, and the heat exchanger is further configured to adjust a temperature of the received quantity of the first chemical solution so as to bring the temperature of the received quantity of the first chemical solution toward a temperature of the received quantity of the second chemical solution.

Optionally, the system further comprises: a flow cell in fluid communication with the heat exchanger, the flow cell configured to analyze an input solution to determine one or more value of at least one parameter of the input solution, the flow cell further configured to selectively receive as the input solution the first chemical solution or the second chemical solution from the heat exchanger.

Optionally, the system further comprises the process tool, and the process tool is configured to receive from the flow cell a quantity of the second chemical solution.

Optionally, the process tool is configured to heat the second chemical solution to a working temperature, and the conduit is configured as a recirculation line that recirculates the heated second chemical solution from the process tool to the heat exchanger.

Optionally, the heat exchanger further includes: a main body that defines an internal space, a first outlet in fluid communication with the first inlet, a second outlet, and a helical pipe contained within the internal space, the helical pipe connected at one end thereof to the second inlet and connected a second end thereof to the second outlet, the helical pipe providing fluid communication between the second outlet and the second inlet and providing a flow channel that supports flow of the second chemical solution or the first chemical solution through the heat exchanger.

Optionally, the heat exchanger further includes a first outlet in fluid communication with the first inlet, and a second outlet in fluid communication with the second inlet, and the system further comprises: a valve arrangement including: a first valve inlet in fluid communication with the first outlet, a second valve inlet in fluid communication with the second outlet, and a valve outlet in fluid communication with the first valve inlet and the second valve inlet, the valve arrangement is configured to selectively provide the first chemical solution or the second chemical solution as an output solution from the valve outlet.

Optionally, the system further comprises: a flow cell in fluid communication with the valve arrangement, the flow cell configured to analyze the output solution from the valve arrangement to determine one or more value of at least one parameter of the output solution, when the valve arrangement provides the first chemical solution as the output solution, the flow cell is configured to operate in a calibration mode in which the flow cell analyzes the first chemical solution to determine one or more value of at least one parameter of the first chemical solution in order to verify that the determined one or more value of the at least one parameter matches a known one or more value of the at least one parameter of the first chemical solution, and when the valve arrangement provides the second chemical solution as the output solution, the flow cell is configured to operate in an operational mode in which the flow cell analyzes the second chemical solution to determine one or more value of the at least one parameter of the second chemical solution.

Optionally, the system further comprises: a temperature sensor arrangement functionally associated with the valve arrangement, the temperature sensor arrangement including at least one sensor configured to monitor temperature of the quantity of the first chemical solution.

Optionally, the system further comprises: a temperature sensor arrangement functionally associated with the heat exchanger, the temperature sensor arrangement including at least one sensor configured to monitor temperature of the quantity of the first chemical solution.

Optionally, the heat exchanger receives the first chemical solution at a first initial temperature and receives the second chemical solution at a second initial temperature that is higher than the first initial temperature, and the heat exchanger is configured to raise the temperature of the first chemical solution toward the second initial temperature.

Optionally, the heat exchanger is further configured to lower the temperature of the second chemical solution toward the first initial temperature.

Optionally, the system further comprises the tank.

Optionally, the tank is part of the process tool.

There is also provided according to an embodiment of the teachings of the present disclosure a system that comprises: a heat exchanger including: a first inlet in fluid communication with a tank that contains a first chemical solution of a known concentration, the first inlet receiving into the heat exchanger a quantity of the first chemical solution from the tank, a second inlet in fluid communication with a conduit that conveys a second chemical solution, the second chemical solution used in a semiconductor manufacturing process by a process tool in fluid communication with the conduit, the second inlet receiving into the heat exchanger a quantity of the second chemical solution from the conduit, a first outlet in fluid communication with the first inlet, and a second outlet in fluid communication with the second inlet, the heat exchanger is configured to adjust a temperature of the received quantity of the first chemical solution so as to bring the temperature of the received quantity of the first chemical solution toward a temperature of the received quantity of the second chemical solution; and a valve arrangement in fluid communication with the first outlet and the second outlet, the valve arrangement configured to selectively provide as an input solution to a flow cell the first chemical solution or the second chemical solution, the flow cell configured to analyze the input solution to determine one or more value of at least one parameter of the input solution.

There is also provided according to an embodiment of the teachings of the present disclosure a method that comprises: providing a quantity of a first chemical solution of a known concentration to a heat exchanger; providing, via a conduit that conveys a second chemical solution from a process tool, a quantity of the second chemical solution to the heat exchanger; and activating, by the heat exchanger, a heat transfer process to adjust a temperature of the provided quantity of the first chemical solution so as to bring the temperature of the provided quantity of the first chemical solution toward a temperature of the provided quantity of the second chemical solution.

There is also provided according to an embodiment of the teachings of the present disclosure a system for verifying and/or calibrating a flow cell that is configured to analyze an input solution. The system comprises: a tank for containing a first chemical solution of a known concentration; a conduit for conveying a second chemical solution, the second chemical solution used in a semiconductor manufacturing process by a process tool in fluid communication with the conduit; and a heat exchanger having a first inlet in fluid communication with the tank, and a second inlet in fluid communication with the conduit, the first inlet receiving into the heat exchanger a quantity of the first chemical solution from the tank, the second inlet receiving into the heat exchanger a quantity of a second chemical solution from the conduit, the heat exchanger configured to adjust a temperature of the received quantity of the first chemical solution so as to bring the temperature of the received quantity of the first chemical solution toward a temperature of the received quantity of the second chemical solution, the heat exchanger further configured to provide the first chemical solution and the second chemical solution as output to a valve arrangement that selectively provides the first chemical solution or the second chemical solution as the input solution to the flow cell.

There is also provided according to an embodiment of the teachings of the present disclosure a system that comprises: a conduit in fluid communication with a semiconductor fabrication process tool, the conduit conveying a process solution used by the semiconductor fabrication process tool; and a heat exchanger including a first inlet for receiving a quantity of a reference solution of a known concentration, and a second inlet in fluid communication with the conduit for receiving a quantity of the process solution from the semiconductor fabrication process tool via the conduit, the heat exchanger is configured to adjust a temperature of the received quantity of the reference solution so as to bring the temperature of the received quantity of the reference solution toward a temperature of the received quantity of the process solution.

Unless otherwise defined herein, all technical and/or scientific terms used herein have the same meaning as commonly understood by one of ordinary skill in the art to which the disclosure pertains. Although methods and materials similar or equivalent to those described herein may be used in the practice or testing of embodiments of the disclosure, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the present disclosure are herein described, by way of example only, with reference to the accompanying drawings. With specific reference to the drawings in detail, it is stressed that the particulars shown are by way of example and for purposes of illustrative discussion of embodiments of the disclosure. In this regard, the description taken with the drawings makes apparent to those skilled in the art how embodiments of the disclosure may be practiced.

Attention is now directed to the drawings, where like reference numerals or characters indicate corresponding or like components. In the drawings.

DESCRIPTION OF THE PREFERRED EMBODIMENTS

Figure 1:
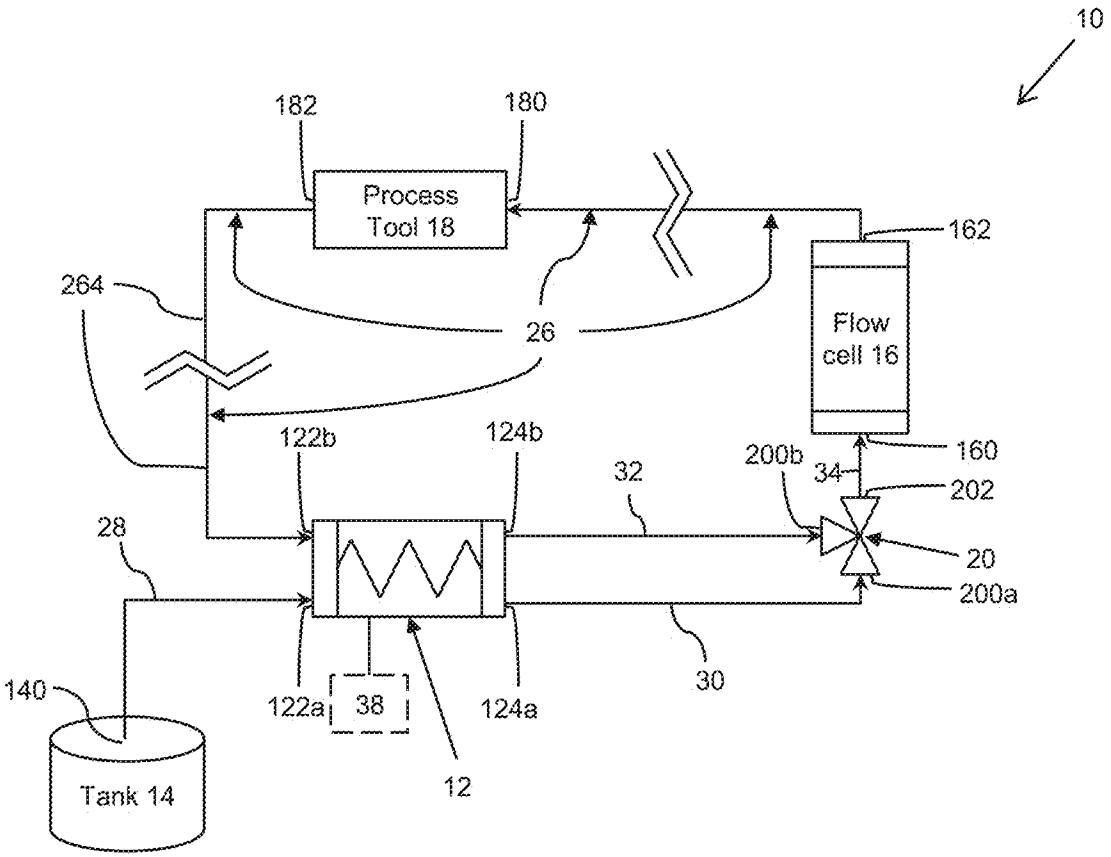
FIG. 1 is a schematic diagram of system configured for use with a semiconductor process tool and a flow cell arrangement, having a storage tank for storing a standard chemical solution, a conduit for conveying a process solution, and a heat exchanger for receiving quantities of the standard chemical solution and the process solution and for adjusting temperature of at least the standard chemical solution, according to an embodiment of the present disclosure.

The present disclosure includes systems and methods for calibrating flow cells used in semiconductor fabrication processes using standard chemical solutions.

The principles and operation of the systems and methods according to present disclosure may be better understood with reference to the drawings accompanying the description.

Embodiments of the present disclosure are applicable for use in semiconductor and/or electronic device manufacturing (fabrication) processes. Within the context of the present disclosure, the interchangeably used terms "semiconductor manufacturing process", "semiconductor manufacture processing", and "semiconductor processing" generally refer to any process for fabricating semiconductors and/or electronic devices (e.g., wafers, such as silicon wafers) in which chemical solutions are used to produce such semiconductors/devices.

Before explaining at least one embodiment of the disclosure in detail, it is to be understood that the disclosure is not necessarily limited in its application to the details of construction and the arrangement of the components and/or methods set forth in the following description and/or illustrated in the drawings and/or the examples. The disclosure is capable of other embodiments or of being practiced or carried out in various ways. Initially, throughout this document, references are made to directions, such as, for example, inner and outer, and the like. These directional references are exemplary only to illustrate the disclosure and the embodiments thereof.

Referring now to the drawings, FIG. 1 schematically illustrates a system, generally designated 10, according to a non-limiting embodiment of the present disclosure. The system 10 is configured for use with a process tool 18 and a flow cell arrangement (also referred to as a "flow cell") 16. In certain non-limiting embodiments, such as the embodiment illustrated in FIG. 1, the process tool 18 and the flow cell arrangement 16 are part of the system 10. It should be noted, however, that in other embodiments either or both of the process tool 18 and the flow cell arrangement 16 can be part of separate systems fluidly connected to components of the system 10.

By way of introduction, the process tool 18 can be, for example, one or more tools in a set of one or more tools which are pieces of manufacturing equipment which handle the manufacturing (fabrication) of semiconductors and/or electronic devices, including wafers or other wafer-like substrates. The manufacturing equipment, including the process tool 18, can include various components, including, for example, one or more process tanks for storing process chemicals, one or more process chambers in which the semiconductor/device (e.g., wafer) is processed by the process tool 18, photolithography equipment, ion implantation equipment, etching equipment, deposition equipment, and the like. The process chemicals, used by the set of one or more tools, include various chemical solutions (referred to as "process solutions"), which are used at different stages of the semiconductor fabrication process. In one non-limiting set of examples, the process tool 18 utilizes one or more process solutions in wet etching and cleaning processing steps which are critical in the generation of patterns on a wafer itself and the deposition of metallic layers on the wafer, the generation of transistors on the wafer, and the generation of dies (the chips on a wafer) and their interconnects (metallic wiring scheme). These process solutions, when used in the context of wet etching and cleaning steps, are also referred to as "cleaning solution".

Due to the increasingly small dimensions of the transistors (for example below 28 nanometer node generation) and their density, the process solutions tend to increase in complexity and dilution in order to prevent damaging the dies features. In order to increase the efficacy of the process solution, some semiconductor manufacturing processes require heating of the process solutions to a desired working temperature. The process solution is heated by the process tool 18, typically by one or more heating elements that heat the process solution while the solution is stored in a tank (reservoir) of the process tool 18 that retains the process solution. For example, the tank (with the process solution) can be heated to a desired working temperature and recirculated with the process chambers of the process tool 18. Generally speaking, the process tool 18 heats the process solution to a working temperature which can be a temperature selected from a range of working temperatures. For example, in certain applications the process tool 18 may heat the process solution to a working temperature that is in the range between 50 to 70 degrees C. The working temperature to which the process solution is heated may depend on the particular application or semiconductor fabrication process. For example, in certain fabrication processes the process solution is heated to a working temperature of 55 degrees C. by the process tool 18, whereas in other fabrication processes the process solution is heated to a working temperature of 65 degrees C.

In wet processes, such as wet etching and/or cleaning in semiconductor manufacture processing, the chemicals in the process solution can be of high cost and typically consist of solvents and harsh (and often volatile) materials. Therefore, recycling of the process solution from the process chambers back to the process storage tank(s) that stores the process solution is of critical importance from both a cost and environmental standpoint. In order to enable use of the harsh process solution during semiconductor processing, and recycling of the harsh process solution, it is critical to measure and monitor the characteristics of the process solution, in particular the concentration of the process solution, to ensure that the process solution is of the appropriate concentration and/or composition for use in the wet etching and cleaning process steps. In the context of the present disclosure, the term "concentration", as in the "concentration of a solution", can refer to the concentration of the components of the solution, which is also referred to herein as "solution concentration", as well as the composition of the solution, which is also referred to herein as "concentrations of different solutes".

In the context of the present disclosure, the steps of measuring and monitoring are performed on-line using the flow cell arrangement 16, which is provided in a fluid flow path between the process tool 18 and the components of the system 10, and may be upstream from the process tool 18 and downstream from the major components of the system 10. The flow cell arrangement 16 is operative to monitor and measure one or more value of at least one parameter of an input chemical solution (e.g., the process solution) by receiving the input solution through an inlet into a body of the flow cell arrangement 16. Light then propagates from a light source to a detector through the flow cell body (having the solution contained therein), and a computer processing system functionally associated with the detector then calculates concentration of the solution (which can include concentration of the various components of the solution) based on the detector measurements. The at least one parameter can include various parameters of the input chemical solution, including, as a primary example, concentration(s) of the input chemical solution and/or pH of the input chemical solution. The flow cell arrangement 16 can be any flow cell typically used in chemical solution analysis, including, for example, the flow cells described in commonly owned U.S. Pat. No. 10,591,408, which is incorporated by reference in its entirety herein. As discussed in the background, in order to ensure analytical accuracy of the flow cell arrangement 16, a periodic measurement of a solution of known chemistry (i.e., known concentration), is introduced in the flow cell measurement channel. The calculated concentration can be compared with the known concentration, and the flow cell system can be calibrated to correct for any deviation. For best calibration, the temperature of the solution of known chemistry should be raised to be close to (or even match) the temperature of the process solution. The embodiments of the present disclosure provide systems and methods which provide, in part, temperature adjustment of the solution of known chemistry prior to introduction into the flow cell arrangement 16 measurement channel, and also provide recirculation of the process solution to the process tool 18.

Bearing the above in mind, and referring again to FIG. 1, the system 10 according to certain embodiments includes a tank (or "vessel" or "reservoir") 14 for containing or storing a first chemical solution having a known concentration, a conduit 26 for conveying the process solution (also referred to as "a second chemical solution") from the process tool 18, and a heat exchanger 12 that receives quantities of the two (i.e., first and second) chemical solutions and activates a heat transfer process to adjust the temperature of the received quantity of the first chemical solution toward the temperature of the received quantity of the second chemical solution. In certain embodiments, the heat transfer process is such that at the end of the heat transfer process the quantity of the first chemical solution and the quantity of the second chemical solution are of approximately same temperature. As will be discussed, in certain embodiments, the initial temperature of the second chemical solution is elevated relative to the initial temperature of the first chemical solution, and the heat transfer process effectively raises the temperature of the first chemical solution toward the initial temperature of the second chemical solution.

The first chemical solution is a chemically stable solution, and is also referred to interchangeably herein as a "standard solution", "standard chemical solution" or simply "standard", or a "reference solution", "known reference solution", "reference chemical solution", "known reference chemical solution" or simply "reference". As is known in the art of analytical chemistry, a standard solution is a stable solution containing a precisely known concentration of an element or a substance. A standard solution can be prepared by dissolving a known mass of solute to make a specific volume. The solute is typically prepared using a standard substance, such as a primary standard. Standard solutions (called titrants or titrators) are used to determine the concentrations of other substances, such as solutions in titration. The concentrations of standard solutions are normally expressed in units of moles per liter (mol/L, often abbreviated to M for molarity), moles per cubic decimeter (mol/$dm^3$), kilomoles per cubic meter (kmol/$m^3$) or in terms related to those used in particular titrations (such as titers). A simple standard is obtained by the dilution of a single element or a substance in a soluble solvent with which it reacts. A primary standard is a reagent that is extremely pure, and is relatively stable. Some primary standards of titration of acids include sodium carbonate. The standard solution can be provided by a chemistry provider with a certificate of analysis that includes the concentration of the standard solution.

The process solution (i.e., the "second chemical solution") can be, for example, a water-based solution with active ingredients which require tight control (hence measurement and monitoring by the flow cell arrangement 16), such as, for example, hydrogen peroxide (H2O2), chelators, surfactants, and inhibitors, and in certain cases Tetramethylammonium hydroxide-solutions (TMAH) or hydrogen fluoride (HF) (for example for tiny etch). The aforementioned examples of process solutions are non-limiting examples of formulated solutions which are typically used in wet etching and cleaning processes of semiconductor processing. It is noted that the process solutions that can be used in embodiments of the present disclosure can also include generic commodity cleaning solutions, such as, for example, isopropyl alcohol (IPA), a solution of ammonia hydroxide-hydrogen peroxide water mixture, a solution of six parts deionized water, one-part hydrochloric acid and one part hydrogen peroxide or HPM (hydrochloric/peroxide mixture), and a solution of concentrated sulfuric acid (H2SO4) and H2O2.

In order to ensure analytical accuracy of the flow cell 16, the standard solution is periodically introduced in the flow cell measurement channel. For best calibration, the temperature of the solution of known chemistry should be elevated (i.e., raised) to be close to (or even match) the temperature of the process solution. The temperature elevation is achieved by heat transfer between the process solution and the standard solution within the heat exchanger 12. Generally speaking, the heat exchanger 12 has a pair of compartments, each compartment supporting the storage and/or flow of one of the two solutions. Specifically, one of the two compartments supports storage and/or flow of the standard solution, and the other of the two compartments supports storage and/or flow of the process solution. The two compartments also define flow channels through which the respective solutions can flow through the heat exchanger 12. The structure of the heat exchanger 12 which accommodates the heat transfer process, according to embodiments of the present disclosure, will now be described.

In the embodiment illustrated in FIG. 1, the heat exchanger 12 includes a pair of inlets 122*a*, 122*b* and a corresponding pair of outlets 124*a*, 124*b*. The inlet 122*a* is fluidly connected with the tank 14, for example via conduit 28, which conveys a quantity (or "sample") of the standard solution from the tank 14, for example via a tank outlet 140, to the inlet 122*a*. Although not illustrated in the drawings, a pump may be provided to pump the quantity of the standard solution to the inlet 122*a*. The quantity of the standard solution provided to (i.e., introduced into) the heat exchanger 12 can be a proportion, for example a small proportion, of the total volume of the standard solution stored in the tank 14. The standard solution is stored in the tank 14 at a storage temperature, for example ambient (i.e., "room") temperature. When the standard solution is introduced into the heat exchanger 12, the standard solution is initially at the storage temperature.

A quantity ("or "sample") of the heated process solution from the process tool 18 is provided to (i.e., introduced into) the heat exchanger 12 through the other inlet 122*b*, and subsequently exits the heat exchanger 12 through the outlet 124*b*. As will be discussed below, the heated process solution may typically continually flow through the heat exchanger 12 from the inlet 122 to the outlet 124*b* during certain operation of the system 10. An aspect of the present disclosure is that the process solution is maintained at or close to working temperature (close to working temperature because temperature of the process solution may drop slightly due natural temperature gradient between the output of the process tool 18 and the input to the heat exchanger) when introduced into the heat exchanger 12. In other words, an aspect of the present disclosure is that the process solution is not allowed to significantly cool before being provided to the heat exchanger 12. In the illustrated embodiment, the process solution is fed into the inlet 122*b* through a conduit 26 that provides fluid connection between at least the process tool 18 and the heat exchanger 12. In certain embodiments, such as the non-limiting embodiment illustrated in FIG. 1, the conduit 26 may provide a fluid connection between the outlet 162 of the flow cell 16 and the inlet 122*b*. The conduit 26 is typically a chemical solution line which may be a tubing line composed of multiple tubing sections, each section providing fluid connection between different components of the system 10 of components associated with the system 10. For example, in the non-limiting embodiment illustrated in FIG. 1, a tubing section 264 of the conduit 26 provides fluid connection from an outlet 182 of the process tool 18 to the inlet 122*b* such that the tubing section 264 conveys the quantity of the process solution from the process tool 18 to the heat exchanger 12.

The heat exchanger 12 is configured to receive the two (i.e., first and second) chemical solutions into respective process solution and standard solution compartments and/or flow channels (which may be in a common main body) of the heat exchanger 12, and to activate a heat transfer process to adjust the temperature of the standard solution toward the temperature of the process solution. This heat transfer process brings the temperature of the standard solution, that is in the heat exchanger 12, toward the temperature of the process solution that is received in (and typically flows through) the heat exchanger 12.

In certain embodiments, the quantity of the standard solution that is held/stored in the standard solution compartment of the heat exchanger 12, is typically several tens of milliliters (mL), and may be up to a few hundred mL. In one non-limiting example, the heat exchanger 12 is configured to hold approximately 100 mL of the standard solution. The quantity of the process solution that flows through the process solution compartment of the heat exchanger 12 is typically a few mL, and may be up to a few tens of mL. In one non-limiting example, the process solution compartment of the heat exchanger 12 is configured to hold approximately 20 mL of process solution at any given moment while the process solution flows through the heat exchanger 12.

Figure 3:
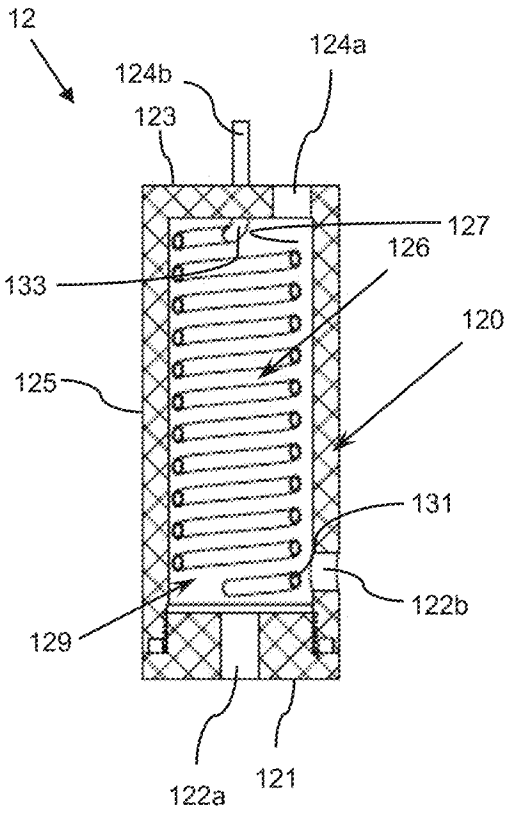
FIG. 3 is a cross-sectional view of the heat exchanger of FIG. 2, taken along the plane III shown in FIG. 2.
Figure 2:
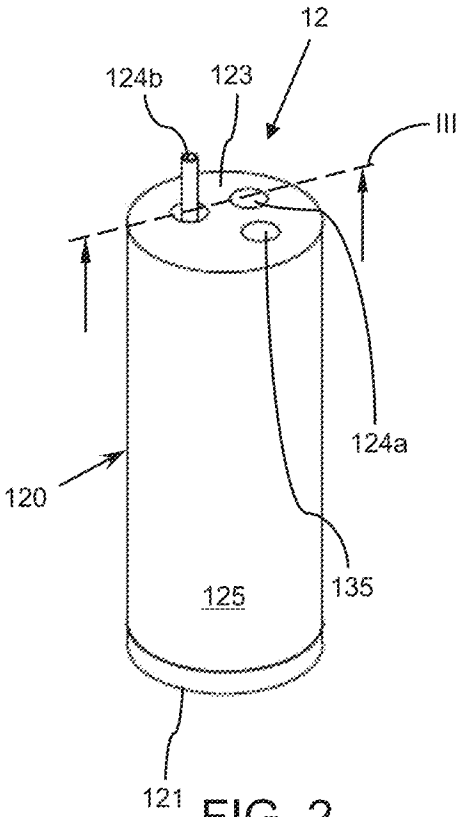
FIG. 2 is an isometric view of the heat exchanger of FIG. 1, implemented according to an embodiment of the present disclosure.

With continued reference to FIG. 1, refer now to FIGS. 2 and 3, which illustrate various views of the heat exchanger 12 implemented according to a non-limiting embodiment of the present disclosure. As illustrated, the heat exchanger 12 includes a cylindrical main body 120 having a pair of opposing circular base ends 121, 123 and a reenforced (thickened) curved sidewall 125. The main body 120 is hollow, defining an interior space 127.

A helical coil (or "pipe") 126 is internal to the main body 120 and is contained within the interior space 127 defined by the hollow main body 120. The coil 126 is hollow, and is fluidly connected at one end 131 thereof to the inlet 122*b* and is fluidly connected at another end 133 thereof to the outlet 124*b*, thereby providing a fluid flow connection between the inlet 122*b* and the outlet 124*b* via the coil 126. The coil 126 is the compartment of the heat exchanger 12 through which the process solution flows. Specifically, the coil 126 provides a flow channel that supports the flow of the process solution through the heat exchanger 12 (and in certain embodiments through the main body 120). This flow channel is referred to as a "process solution flow channel". As mentioned above, the during certain operation of the system 10 the heated process solution may typically continually flow through the heat exchanger 12 from the inlet 122 to the outlet 124*b*, and thus may typically continually flow through the coil 126 during certain operation of the system 10.

The coil 126 occupies a portion of the volume of the internal space 127. The portion of the volume of the internal space 127 that is not occupied by the coil 126 defines an unoccupied internal volume 129 of the main body 120. The internal volume 129 of the main body 120 provides a compartment of the heat exchanger 12 in which the standard solution is stored in the heat exchanger 12, and further provides a flow channel that supports the flow of the standard solution through the heat exchanger 12 (and in the illustrated embodiment, through the main body 120). This flow channel is referred to as a "standard solution flow channel".

Due to the helical coil design of the heat exchanger 12, the two solutions flow approximately perpendicular to one another through the heat exchanger 12.

The coil 126 has a solid external surface, which prevents the process solution flowing through the process solution flow channel provided from mixing with the standard solution flowing through the standard solution flow channel.

In certain embodiments, the coil 126 may be wrapped around a core structure within the internal space 127. In such embodiments, the internal volume 129 is defined by the volume of the internal space 127 that is not occupied by the coil 126 and the core structure.

The main body 120 and the coil 126 are designed to withstand harsh chemicals and high heat, as the process solution is composed of harsh chemicals and is typically heated to a working temperature, for example in the range of 50 to 70 degrees C. by the process tool 18 and is not allowed to significantly cool before injection into the heat exchanger 12. For example, the coil 126 may be constructed from a Per- and polyfluoroalkyl substance (PFA), such as Polytetrafluoroethylene (PTFE), commercially branded as "Teflon" from DuPont. Some of the design parameters of the coil 126, such as the diameter of pipe, the radius of the helical curve of the coil, the tightness of the coil winding, etc.) are selected such that the spiral length of the coil 126 (and hence the volume of process solution that can be retained within the interior volume of coil 126) is proportional to the volume (quantity) of the standard solution introduced into the internal volume 129 of the main body 120.

In the embodiment illustrated in FIGS. 2 and 3, the inlet 122*a* and the outlet 124*a* are positioned at the base ends 121 and 123, respectively. The outlet 124*b* is also positioned at the same circular base end 123 of the main body 126 as the outlet 124*a*. In addition, the inlet 122*b* is positioned on a lower portion of the curved sidewall 125 of the cylindrical main body 120, close to the circular base 121 end at which the inlet 122*a* is positioned.

Figure 4:
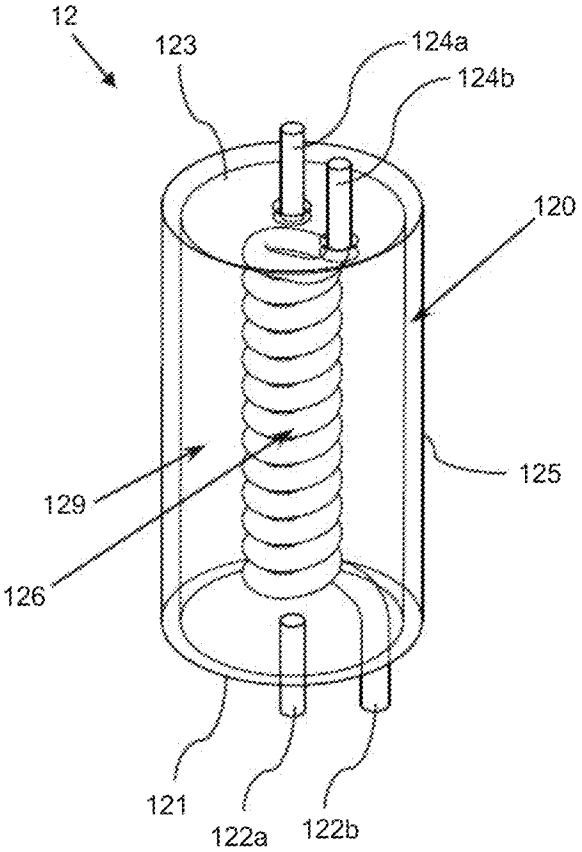
FIG. 4 is an isometric view of a heat exchanger implemented according to another embodiment of the present disclosure.

It is noted, however, that other configurations of the heat exchanger are possible in which the locations of one or more of the inlets 122*a*, 122*b* and the outlets 124*a*, 124*b* are different from as illustrated in FIGS. 2 and 3. For example, FIG. 4 illustrates an alternative embodiment in which the inlet 122*a* and the outlet 124*a* are positioned at the opposing circular base ends (121 and 123) of the main body 120 at or near the radial center of the coil 126. In addition, the inlet 122*b* is located at the same circular base end 121 of the main body 126 as the inlet 122*a*.

Figure 5:
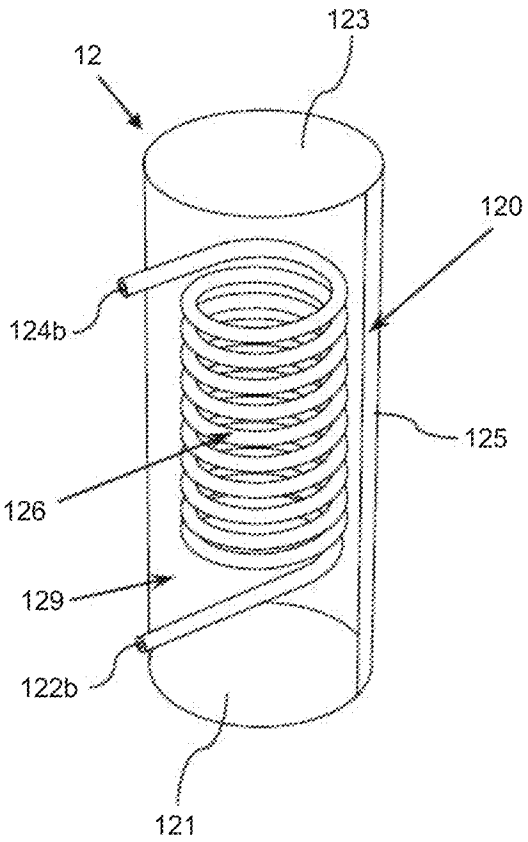
FIG. 5 is an isometric view of a heat exchanger implemented according to a further embodiment of the present disclosure.

FIG. 5 illustrates yet another embodiment in which the inlet 122 and the outlet 124*b* are both located on the curved sidewall 125 of the cylindrical main body 120, and preferably, but not necessarily, on the same side of the curved sidewall 125.

In the embodiments illustrated in FIGS. 2 through 5, the coil 126 is arranged within the main body 120 so that the longitudinal dimension of the coil extends between the circular base ends 121 and 123 of the cylindrical main body 120. In the embodiments of FIGS. 2 through 4, the radius of the helical curve of the coil is smaller than that of the radius in the embodiment of FIG. 5, and the length of the coil 126 is approximately equal to the height of the cylinder (the main body 120) such that the ends of the coil are at or near the respective circular base ends 121 and 123 of the main body 120.

To further prevent mixing of the process solution and the standard solution in their respective flow channels within the main body 120, the heat exchanger 12 may be hermetically sealed at inlets 122*a*, 122*b* and the outlets 124*a*, 124*b*. In certain embodiments, one or more of the inlets 122*a*, 122*b* and outlets 124*a*, 124*b* may protrude out of the main body 120, for example through sealed openings in the base ends 121, 123 or sidewall 125 of the main body 120. For example, in the embodiment illustrated in FIG. 4, the inlets 122*a* and 122*b* may protrude outward from the main body 120 through sealed openings in the base end 121, and the outlets 124*a* and 124*b* may protrude outward from the main body 120 through sealed openings in the base end 123. As another example, in the embodiment illustrated in FIG. 5 the inlet 122 and the outlet 124*b* may protrude outward from the main body 120 through respective sealed openings in respective lower and upper portions of the curved sidewall 125.

The features of the heat exchanger 12, for example the features of the helical pipe 126 and the features of the main body 120, provide increased efficiency of the heat transfer between the two solutions. The features of the helical pipe 126 and/or the main body 120 can be designed to optimize the heat transfer between the two solutions. Optimization of heat transfer can also be achieved by further modification of the heat exchanger 12, for example by adding additional structures, such as additional coils, fins, or corrugations.

Regardless of the particular configuration of the heat exchanger 12, in operation, when the standard solution and the process solution pass through the heat exchanger 12 (through their respective flow channels), a heat exchange (heat transfer) process takes place, whereby the temperatures of the two solutions are adjusted such that the standard solution and the process solution are brought into closer temperature to each other (and in certain cases approximately identical temperature) at the outlets 124*a*, 124*b* of the heat exchanger 12. The heat transfer process activated by the heat exchanger 12 is in accordance to the laws of thermodynamics, in which heat flows into a fluid by diffusion to increase its energy, and the fluid then transfers this increased internal energy from one location to another, and this is then followed by a second thermal interaction which transfers heat to a second fluid, again by diffusion.

As mentioned above, some of the design parameters of the coil 126 can be selected such that the volume of process solution that can be accommodated to flow within the interior volume of coil 126 is proportional to the volume of the standard solution within the internal volume 129 of the main body 120. When using the exemplary volumes of 100 mL of standard solution and 20 mL of process solution, and when the process solution flows through the coil 126 at a reasonably high rate of flow, the heat exchanger 12 is able to heat the standard solution to requisite temperature within a few minutes.

Although not shown in the drawings, the heat exchanger 12 may, in certain embodiments, include a release outlet/valve for allowing some or all of the standard solution temporarily stored in the internal volume 129 of the main body 120 to be discharged from the heat exchanger 12. The release outlet may be fluidly connected to the inlet 122*a* and the internal volume 129, which allows for discharging of the standard solution. In certain embodiments, the standard solution can be discharged from the heat exchanger back to the tank 14 or to a drain, for example via a return conduit or a drain conduit fluidly connected to the release outlet.

Returning to FIG. 1, the heat exchanger 12 is fluidly connected to the flow cell 16 via a valve arrangement 20, illustrated here as a three-way valve 20. The valve 20 includes a pair of inlets 200*a*, 200*b* and a single outlet 202, and is configured to selectively provide the standard solution or the process solution as an output solution from the valve outlet 202. The inlet 200*a* is fluidly connected to the outlet 124*a* via a standard solution conduit 30, which conveys the standard solution from the outlet 124*a* to the valve inlet 200*a*. The inlet 200*b* is fluidly connected to the outlet 124*b* via a process solution conduit 32, which conveys the process solution from the outlet 124*b* to the valve inlet 200*b*. The valve 20 can be operated to switch between two valve states. In a first valve state, the valve 20 is switched such that the standard solution flows from the outlet 124*a* to the valve outlet 202 via the conduit 30. In a second valve state, the valve 20 is switched such that the process solution flows from the outlet 124*b* to the valve outlet 202 via the conduit 32.

The valve outlet 202 is fluidly connected to an inlet 160 of the flow cell 16 via a conduit 34, such that the flow cell 16 can selectively receive as the input solution (via the inlet 160) the standard solution or the process solution from the heat exchanger 12. Accordingly, depending on the switch state of the valve 20, the standard solution or the process solution can be introduced as an input solution into the flow cell measurement channel via the inlet 160.

Generally speaking, the system 10 is configured to operate in an operational mode and in a calibration mode. When the system 10 operates in the operational mode, the flow cell 16 is likewise configured to operate in an operational mode, and when the system 10 operates in the calibration mode, the flow cell is likewise configured to operate in a calibration mode.

When the system 10 (and flow cell 16) operates in operational mode, the process solution is recirculated from the process tool output 182 through the heat exchanger 12 (via the coil 126) and to the valve 20, which assumes its second valve state. Since the valve 20 assumes its second valve state, the process solution flows from the outlet 124*b* to the valve outlet 202 (via the valve inlet 200*b* and the conduit 32) and into the flow cell 16 (via the inlet 160). As the process solution flows through the flow cell measurement channel (between the inlet 160 and the outlet 162), the flow cell 16 analyzes the process solution, and one or more value of the concentration of the process solution is determined (e.g., calculated) based on the measurements collected at the detector associated with the flow cell 16, as is known in the art.

Parenthetically, the temperature of the process solution at the input (inlet 122*b*) to the heat exchanger 12 is ideally the working temperature. In practice, however, the process solution will be at a slightly lower temperature than the working temperature, for example to due natural temperature gradient between the output of the process tool 18 and the input to the heat exchanger 12.

When the system 10 (and flow cell 16) operates in calibration mode, the valve 20 assumes its first valve state and the standard solution is introduced into the internal volume 129 of the main body 120 of the heat exchanger 12. The heat exchanger 12 performs the heat exchange process to raise the temperature of the standard solution, stored within the main body 120, toward the working temperature of the process solution. Since the valve 20 assumes its first valve state, the standard solution flows from the outlet 124*a* to the valve outlet 202 (via the valve inlet 200*a* and the conduit 30) and into the flow cell 16 (via the inlet 160). As the standard solution flows through the flow cell measurement channel (between the inlet 160 and the outlet 162), the flow cell 16 analyzes the standard solution, and value(s) of the concentration of the standard solution is determined (e.g., calculated) based on the measurements collected at the detector associated with the flow cell 16, as is known in the art. Since the standard solution is a chemically stable solution having a known concentration, a verification of the flow cell 16 analytics can be performed in order to verify that the known value(s) of the concentration of the standard solution matches the value(s) of the concentration calculated/determined by the flow cell 16. This verification can be performed by the computer processing system that determines/calculates the concentration from the detector measurements. In certain embodiments, if a mismatch between the known concentration and determined/calculated concentration is identified, a flow cell calibration step can be performed, for example by adjusting in software the concentration calculations performed by the computer processing system and/or re-calibrating the hardware components of the flow cell 16 itself.

In certain embodiments, the quantity of the standard solution may be introduced (e.g., from the tank 14) into the internal volume 129 of the main body 120 of the heat exchanger 12 during operation of the system 10 in operational mode. In other embodiments, some, or all of the quantity of the standard solution may already be present in the internal volume 129. During operation of the system 10 in operational mode, the process solution may continually flow through the process solution flow channel of the heat exchanger 12 (i.e., from the inlet 122*b* to the outlet 124*b* via the coil 126), thereby activating a heat transfer process such that the initial temperature of the standard solution is raised toward the working temperature of the process solution. Once the standard solution is heated to the appropriate temperature, the system 10 may be switched to calibration mode, whereby the valve 20 is switched so as to supply the standard solution to the flow cell 16. The switching of the valve may be based on a temperature reading of the standard solution contained within the internal volume 129, for example via a temperature sensor of a temperature sensor arrangement 38 (FIG. 1).

Figure 6:
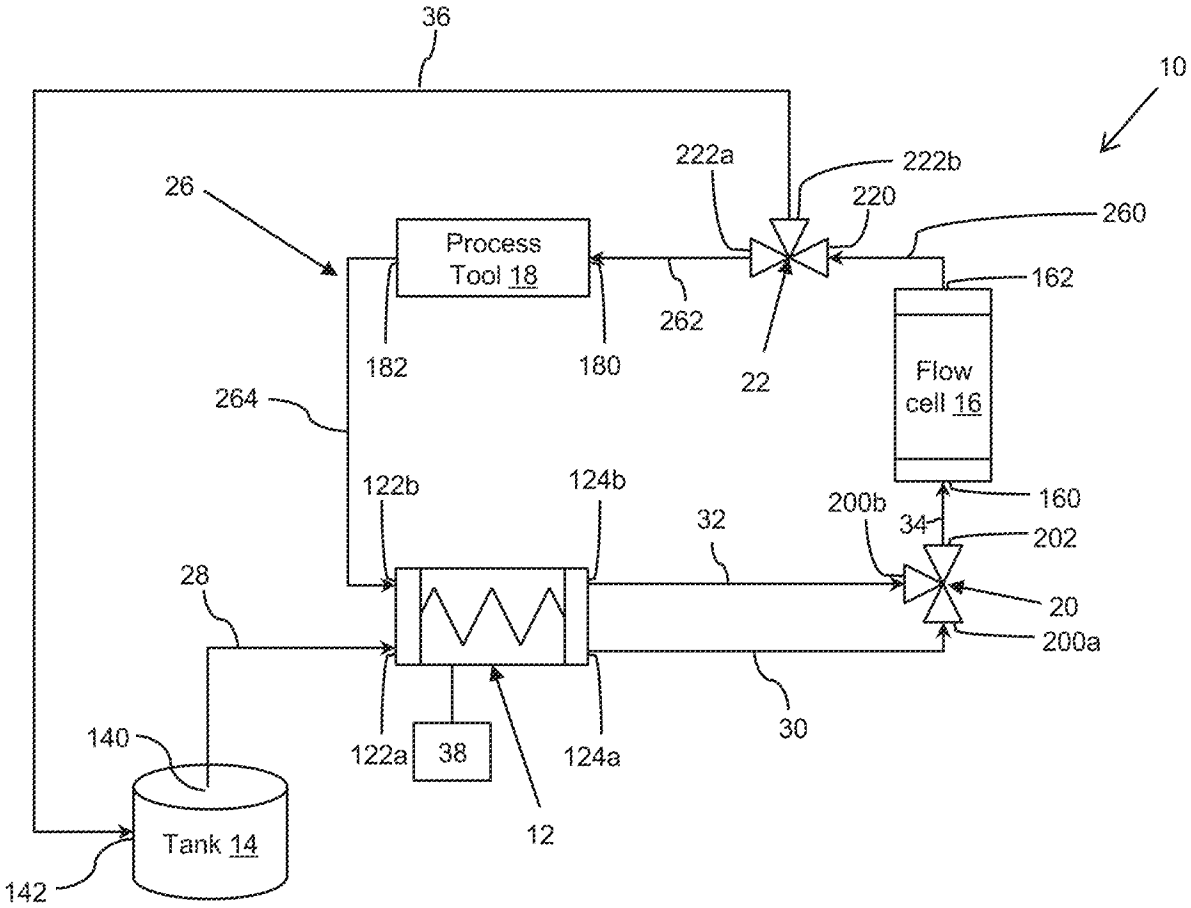
FIG. 6 is a schematic diagram of a system similar to the system of FIG. 1, having a valve arrangement that provides selective recirculation of a process solution and the standard chemical solution, according to an embodiment of the present disclosure.

According to certain aspects of the present disclosure, the conduit 26 is configured as a recirculation line that recirculates the heated process solution from the process tool 18 to the heat exchanger 12. In certain embodiments, the recirculation also accommodates the flow of the process solution from the output of the flow cell 16 to the input of the process tool 18 when the system 10 operates in operational mode. In such embodiments, it may be preferable that when the system 10 operates in calibration mode (i.e., when the solution analyzed by the flow cell 16 is the standard solution), the standard solution not be introduced into the process tool 18. Thus, according to certain non-limiting embodiments, there is provided selectivity of which solution from the output of the flow cell 16 is recirculated to the input of the process tool 18. This selectivity can, according to certain non-limiting embodiments of the present disclosure, be provided by an additional valve arrangement, deployed between the flow cell 16 and the process 18, and fluidly connected to sections of the conduit 26. FIG. 6 schematically illustrates a non-limiting example of a system according to such an embodiment. Here, the conduit 26 includes two further tubing sections 260, 262 (in addition to the tubing section 264), which provides fluid connection between the flow cell 16 output and the process tool 18 input via a valve arrangement 22, represented in FIG. 6 as a three-way valve 22. The valve 22 includes a single inlet 220 and a pair of outlets 222*a*, 222*b*. The inlet 220 is fluidly connected to the outlet 162 of the flow cell 16 via the tubing section 260 of the conduit 26, which conveys the solution (either the standard solution or the process solution, depending on the operating mode of the system 10) from the flow cell 16 output to the valve inlet 220. The outlet 222*a* is fluidly connected to the input/inlet 180 of the process tool 18 via the tubing section 262 of the conduit 26. In certain embodiments, the outlet 222*b* is fluidly connected to an inlet 142 of the tank 14 via a return conduit 36, which allows for the standard solution to be recirculated back to the tank 14. In other embodiments, the outlet 222*b* is fluidly connected to a drain.

The valve 22 can be operated to switch between two valve states. In a first valve state, the valve 22 is switched such that the solution that passes through the flow cell 16 flows from the flow cell outlet 162 to the input/inlet 180 of the process tool 18. In a second valve state, the valve 22 is switched such that the solution that passes through the flow cell 16 flows from the flow cell outlet 162 to the tank 14.

The valve 22, similar to the valve 20, assumes its valve states in accordance with the operating mode of the system 10. When the system 10 (and flow cell 16) operates in operational mode, the valve 22 assumes its first valve state. Since the valve 22 assumes its first valve state, the process solution that passes through the flow cell 16 flows from the flow cell outlet 162 to the input/inlet 180 of the process tool 18 (via the tubing section 260, the valve inlet 220, the valve outlet 222*a*, and the tubing section 262), thus being recirculated back into the process tool 18. When the system 10 (and flow cell 16) operates in calibration mode, the valve 22 assumes its second valve state. Accordingly, the solution under analysis by the flow cell 16, which in calibration mode is the standard solution, does not flow into the process tool 18, and instead flows from the flow cell outlet 162 to the tank 14 (via the tubing section 260, the valve inlet 220, the valve outlet 222*b*, and the conduit 36). In other embodiments, the conduit 36 may fluidly connect the valve outlet 222*b* to the inlet 122*a* of the heat exchanger 12, allowing the standard solution to flow directly back into the internal volume 129 of the main body 120, bypassing the tank 14. In yet other embodiments, the conduit 36 may fluidly connect the valve outlet 222*b* to a drain instead of the tank 14.

In certain embodiments, the tank 14 may be periodically refilled with the standard solution, for example from an external source.

It is noted that the temperature of the process solution that exits the heat exchanger 12 and/or the flow cell 16 (regardless of the mode of operation of the system 10) is typically lower than the working temperature of the process solution that is required for the semiconductor manufacturing process. This may be due to natural temperature gradient along the flow path between the process tool output and the flow cell output. As stated above, the process tool 18 functions to heat the process solution to the working temperature. Therefore, in situations in which process solution is recirculated back to the input of the process tool 18 from the heat exchanger 12 and/or the flow cell 16, the recirculated process solution undergoes reheating by the process tool 18 to bring the temperature of the recirculated process solution back up to the requisite working temperature.

It is noted that in certain situations, the chemistry of the standard solution may be such that it may not alter the process solution chemistry enough to reduce the cleaning and etching efficacy of the process solution if the quantity of standard solution is introduced into the process tool 18 and mixed with the process solution. Therefore, in certain embodiments, the valve 22 may not be needed (or may be configured to assumes its first valve state even when the system 10 operates in calibration mode), and the output from the flow cell 16 may be circulated into the input of the process tool 18

Referring again to FIG. 1, according to certain embodiments a temperature sensor arrangement 38 is functionally associated with the heat exchanger 12, and is configured to monitor the temperature of the quantity of the standard solution in the heat exchanger 12 and the temperature of the quantity of the process solution in the heat exchanger 12. The temperature sensor arrangement 38 may include a first set of one or more temperature sensors that monitor the temperature of the standard solution in the heat exchanger 12*b*, and a second set of one or more temperature sensors that monitor the temperature of the process solution in the heat exchanger 12. According to certain non-limiting embodiments, such as the embodiment illustrated in FIG. 2, the heat exchanger 12 may include a sealed opening 135 which provides the functional association between the temperature sensor arrangement 38 and the heat exchanger 12. In the illustrated embodiment, the opening 135 provides an inlet to the internal volume 129 which allows the temperature sensor arrangement 135, for example implemented as a thermistor, to probe the quantity of the standard solution temporarily stored in the internal volume 129 of the main body 120 in order to perform temperature measurement of the standard solution. A similar opening may be provided in the main body of the coil 126 to accommodate another temperature sensor (e.g., thermistor) to probe the process solution flowing through the coil 126 in order to perform temperature measurement of the process solution.

In other embodiments, one or more of the temperature sensors of the temperature sensor arrangement may be functionally associated with the valve 20, for example by being located at the inlet 200*a* and/or the inlet 200*b* and/or the outlet 202 of the valve 20.

The temperature sensor arrangement 38 may be functionally associated with a computerized processor or other computerized controller, which controls switching of the system 10 between operational mode and calibration mode. For example, the system 10 may be configured to switch to calibration mode only when the temperature sensor arrangement 38 indicates that the temperature of the standard solution is above a threshold temperature (which can be a pre-set threshold or a dynamically adjustable threshold), or when the final temperature difference between the two solutions (i.e., after the heat transfer process is complete) is within a certain range. In general, the required final temperature difference between the two solutions (i.e., after the heat transfer process is complete) may depend on the particular application. Preferably, the final temperature difference should not exceed 5 degrees C., but for higher accuracy it is preferable that the final temperature difference not exceed 3 degrees C., and more preferably not exceed 1 degree C.

In certain embodiments, the heat transfer process accommodated by the heat exchanger 12 is such that simultaneously the temperature of the standard solution is raised and the temperature of the process solution is lowered so that the two solutions will each be at an equivalent temperature, i.e., so that the temperatures of the two solutions will be approximately equal to each other. It is noted, however, that in practice, equivalent temperature of the two solutions may not be necessary (and in certain cases may be difficult to achieve). Nevertheless, the heat exchanger 12 according to the embodiments of the present disclosure, avoids temperature "shock" to the flow cell 16 (situations in which the temperatures of the two solutions are different by a significant amount, such as 5 or more degrees C., or 3 or more degrees C., or 1 or more degrees C., depending on the application and required accuracy), and averts the need to allow the solution of the process solution to cool to room temperature (i.e., the storage temperature of the standard solution in the tank 14) when operating the system 10 in calibration mode. As such, the heat exchanger 12, in combination with the other major components of the system 10 of the embodiments of the disclosure, provides significant advantages over conventional approaches. One advantage is reduced design complexity by virtue of the fact that the system 10 does not require active heating or cooling elements. Another advantage is the cost-effectiveness of the system 10 as a result of the reduction in equipment and energy expenses typically associated with active heating and/or cooling elements. Yet another advantage is the faster calibration cycle achievable by the system 10, whereby the time required to verify and calibrate the flow cell 16 is reduced due to the fact that the standard solution is preheated (via the heat exchanger 12). A further advantage is safety as compared to conventional systems, as the system 10 according to embodiments of the disclosure does not necessitate the need for electrical power-driven (i.e., active) heating and/or cooling elements in the presence of often volatile process solution chemicals, which in conventional systems can present as a safety hazard.

As discussed above, the system 10 includes, or is functionally associated with, one or more valve arrangements that are each configured to be switched to assume one of two valve states. In certain embodiments, the valves are pneumatic-type valves, and are controlled by an automatic pneumatic manifold which uses compressed air (clean-dry-air) or another gas (e.g., Nitrogen) to actuate valve switching. In other embodiments, the valve switching can be electromechanically controlled, for example by a servo or other suitable motor coupled to a computerized controller having one or more hardware processor coupled to a suitable computerized storage medium such as a memory or the like. In certain embodiments, the computerized controller can be part of a processing and control system that execute processing and control tasks for the various components of, or otherwise associated with, the system 10. For example, the processing and control system can include computerized processing elements associated with the detector (that is associated with the flow cell 16) that functions to determine/calculate one or more values of the concentration of solutions that pass through the flow cell measurement channel. Such a processing and control system may further include computerized processing and/or control elements that function to control the process tool 18 as well as any of the other process tools that are pieces of the manufacturing equipment which handle the semiconductor manufacture process. Such a processing and control system may further control pumps or other devices configured to move fluids (e.g., the standard solution, the process solution, etc.) from one part or component of the system 10 to another part or component of the system.

It should be appreciated that in certain embodiments of the heat exchanger according to the present disclosure the flow channel that supports flow of the standard solution and the flow channel that supports flow of the process solution may be swapped. Thus, for example, although certain embodiments of the heat exchanger described thus far have pertained to a configuration in which the process solution flows through a coil that supports a process solution flow channel and in which the standard solution is retained in (or flows through) an internal volume that supports a standard solution flow channel, embodiments of the heat exchanger are contemplated herein in which the standard solution flows through the coil and the process solution flows through the internal volume. In such embodiments, the corresponding heat exchanger outlets should be re-routed to the appropriate inlets of the valve 20. In addition, it should be appreciated that the heat exchanger 12 described herein and illustrated in the accompanying drawings represent only a set of non-limiting examples of heat exchangers that can be implemented and used with the embodiments of the disclosed subject matter. The heat exchangers described and illustrated herein can be modified in various ways and still provide heat exchange process functionality, as should be apparent to those of ordinary skill in the art. For example, although the heat exchangers have been described herein as having a helical coil deployed within a cylindrical main body 120 with circular base ends 121, 123, the heat exchangers according to the present disclosure may have a main body consisting of a cylindrical section with outwardly curved (i.e., convex) base ends (e.g., hemispherical base ends), resulting in a capsule-type shape. As another example, the heat exchangers according to the present disclosure may have a hollow main body for accommodating the flow of one of the chemical solutions (e.g., the standard solution or the process solution) therethrough and a coil wrapped (coiled) around the main body for accommodating the flow of the other chemical solution (e.g., the process solution or the standard solution) therethrough. As yet another example, the heat exchangers according to the embodiments of the present disclosure may be implemented according to a spiral configuration, in which the main body is replaced with a second coil that provides a flow channel that supports flow of the standard solution. In such a configuration, the two coils are interwound which allows the two solutions to flow parallel to one another. Such interwound spiral heat exchanger designs are well-known in the art.

Although the embodiments discussed thus far have been described in the context of the tank 14 being part of the system 10, it should be appreciated that in certain embodiments the standard solution may be provided to the heat exchanger 12 from a source that is not a part of the system 10. For example, the tank 14 may not necessarily form a part of the system 10, and may, in turn, be part of a separate system that is fluidly connected to the system 10. For example, the tank 14 may be part of the facility that houses the process tool 18. Therefore, a system that comprises a heat exchanger having a first compartment (i.e., internal volume) supporting a standard solution flow channel and a second compartment (e.g., coil) supporting a process solution flow channel, and optionally further comprises a conduit that feeds the second compartment with process solution, also falls within the scope of subject matter that may be claimed. It is also noted that the heat exchanger according to certain embodiments of the present disclosure is believed to be of utility and patentability in its own right. Thus, a heat exchanger according to certain embodiments of the present disclosure falls within the scope of subject matter that may be claimed.

It is noted that the process tool 18 may use a plurality of process solutions, with each process solution being used for a different stage of the semiconductor fabrication process. In certain cases, each process solution may require heating to a different respective working temperature. For example, a first process solution may be heated by the process tool 18 to a first working temperature as part of a wet etching stage, and a second process solution may be heated by the process tool 18 to a second working temperature as part of a cleaning stage. To this effect, process solution that is circulated through the system 10 may change from operational cycle to operational cycle, with each cycled process solution operating at a different working temperature. Accordingly, the standard solution may be heated to a different working temperature by the heat exchanger 12 depending on the type of process solution currently being circulated through the system, for example based on the particular stage of the fabrication process. In certain embodiments, a separate heat exchanger 12 may be provided for each process solution. In such embodiments, each heat exchanger 12 may be fluidly connected with its own flow cell 16 for performing analysis of the particular process solution and standard solution associated with that heat exchanger. Therefore, embodiments are contemplated herein in which there are a plurality of heat exchangers (each being implemented according to any of the embodiments discussed herein) and a corresponding plurality of flow cells. In such embodiments, the heat exchangers may each be according to the same implementation, or different heat exchangers may be according to different implementations. For example, one of the heat exchangers may be implemented according to the embodiment illustrated in FIGS. 2 and 3, whereas another of the heat exchangers may be implemented according to a spiral configuration.

Furthermore, the optical properties of the process solution (or solutions) and the standard solution may change as a function of temperature. Due to this temperature-dependent change, it may be advantageous, in certain cases, to perform more than one flow cell measurement of the standard solution at corresponding heated temperatures, for example by heating the standard solution to a first heated temperature and then introducing the standard solution into the flow cell measurement channel at the first heated temperature, and then heating the standard solution to a second heated temperature (different from the first heated temperature) and then introducing the standard solution into the flow cell measurement channel at the second heated temperature. This may be repeated for a third heated temperature, and so on, as needed. Although not illustrated in the drawings, in certain embodiments the temperature sensor arrangement 38 may include a third set of one or more temperature sensors that monitor the temperature of the solution (either process solution or standard solution) flowing through the flow cell(s). Such embodiments provide capability to monitor the chemical solution at various stages of flow through the system 10 and its associated components, which enables more robust verification of the analysis performed by the flow cell(s).

It is noted that any contamination of the process solution by residual amounts of standard solution in the flow cell is typically insignificant. However, the flow cell 16 (or flow cells) may be flushed or primed between switches between operational and calibration modes to further reduce risk of contamination or mixing of residual amounts of the process solution and standard solution within the flow cell(s). This priming may be accomplished by providing one or more tank containing a volume of a flushing/priming solution (which may be water) fluidly connected to the flow cell(s).

As discussed above the flow cell(s) is/are operative to monitor and measure one or more value of at least one parameter of an input chemical solution (e.g., the process solution, the standard solution, etc.), which can include, for example, concentration(s) of the input chemical solution and/or pH of the input chemical solution. Although many of the embodiments discussed herein have been described within the context of concentration(s) of a chemical solution being the parameter of the solution that is measured or monitored by the flow cell, it should be clear that the embodiments described herein are equally applicable to situations in which the pH of the input chemical solution is the parameter measured or monitored by the flow cell(s) either instead of or in addition to the concentration(s). It should therefore be clear that the scope of the appended claims should not be limited to a specific parameter of the chemical solution unless explicitly stated otherwise.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

As used herein, the singular form, "a", "an" and "the" include plural references unless the context clearly dictates otherwise.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

It is appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable subcombination or as suitable in any other described embodiment of the disclosure. Certain features described in the context of various embodiments are not to be considered essential features of those embodiments, unless the embodiment is inoperative without those elements.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the disclosure.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the disclosure.

Although the disclosure has been described in conjunction with specific embodiments thereof, it is evident that many alternatives, modifications, and variations will be apparent to those skilled in the art. Accordingly, it is intended to embrace all such alternatives, modifications and variations that fall within the spirit and broad scope of the appended claims

What is claimed is:

1. A system comprising:

a conduit;

a heat exchanger including:

a first inlet in fluid communication with a tank that contains a first chemical solution of a known concentration at an ambient storage temperature, a second inlet in fluid communication with the conduit, wherein the conduit is in fluid communication with a semiconductor manufacturing process tool that manufactures semiconductors and that is configured to heat a second chemical solution to a working temperature that is greater than the ambient storage temperature, a first outlet in fluid communication with the first inlet, and a second outlet in fluid communication with the second inlet, wherein the conduit conveys the second chemical solution from the semiconductor manufacturing process tool to the second inlet, wherein the heat exchanger is configured to receive a quantity of the first chemical solution via the first inlet and a quantity of the second chemical solution via the second inlet to activate heat transfer between the quantity of the first chemical solution and the quantity of the second chemical solution so that the temperature of the received quantity of the first chemical solution is raised toward the working temperature;

a first valve including:

a first valve inlet in fluid communication with the first outlet, a second valve inlet in fluid communication with the second outlet, and a valve outlet in fluid communication with the first valve inlet and the second valve inlet, wherein the first valve is configured to selectively provide the first chemical solution or the second chemical solution as an output solution from the valve outlet; and a flow cell having a flow cell inlet and a flow cell outlet, the flow cell inlet in fluid communication with the valve outlet for receiving as an input solution the output solution from the valve outlet, the flow cell configured to analyze the input solution to determine one or more value of at least one parameter of the input solution, the flow cell outlet in fluid communication with the semiconductor manufacturing process tool via a second valve to selectively provide the input solution to the semiconductor manufacturing process tool.

2. The system of claim 1, wherein the system further comprises the semiconductor manufacturing process tool.

3. The system of claim 1, wherein the conduit is configured as a recirculation line that recirculates the heated second chemical solution from the semiconductor manufacturing process tool to the heat exchanger.

4. The system of claim 1, wherein the heat exchanger further includes:

a main body that defines an internal space, and a helical pipe contained within the internal space, the helical pipe connected at one end thereof to the second inlet of the heat exchanger and connected at a second end thereof to the second outlet of the heat exchanger, the helical pipe providing fluid communication between the second outlet and the second inlet and providing a flow channel that supports flow of the second chemical solution or the first chemical solution through the heat exchanger.

5. The system of claim 1, wherein when the first valve provides the first chemical solution as the output solution, the flow cell is configured to operate in a calibration mode in which the flow cell analyzes the first chemical solution to determine one or more value of at least one parameter of the first chemical solution in order to verify that the determined one or more value of the at least one parameter of the first chemical solution matches a known one or more value of the at least one parameter of the first chemical solution, and wherein when the first valve provides the second chemical solution as the output solution, the flow cell is configured to operate in an operational mode in which the flow cell analyzes the second chemical solution to determine one or more value of the at least one parameter of the second chemical solution.

6. The system of claim 1, further comprising: a temperature sensor arrangement functionally associated with the first valve, the temperature sensor arrangement including at least one sensor configured to monitor temperature of the quantity of the first chemical solution.

7. The system of claim 1, further comprising: a temperature sensor arrangement functionally associated with the heat exchanger, the temperature sensor arrangement including at least one sensor configured to monitor temperature of the quantity of the first chemical solution.

8. The system of claim 1, wherein the heat transfer activated by the heat exchanger lowers the temperature of the second chemical solution toward the ambient storage temperature.

9. The system of claim 1, wherein the system further comprises the tank.

10. The system of claim 1, wherein the tank is part of the semiconductor manufacturing process tool.

* * * * *